US006065152A

United States Patent [19]

Parker

[11] Patent Number: 6,065,152

[45] Date of Patent: May 23, 2000

[54] ATHLETIC SHIN GUARD

[75] Inventor: Jon S. Parker, Portland, Oreg.

[73] Assignee: Adidas-Salomon AG, Germany

[21] Appl. No.: 09/063,972

[22] Filed: Apr. 21, 1998

Related U.S. Application Data

[63] Continuation of application No. 08/635,370, Apr. 19, 1996.

[51] Int. Cl.[7] ..... A41D 13/00

[52] U.S. Cl. ..... 2/22; 2/455

[58] Field of Search ..... 2/22, 23, 24, 455, 2/456, 908, 911; 602/23, 27; 128/882

[56] References Cited

U.S. PATENT DOCUMENTS

| | | | |
|---|---|---|---|
| 3,772,704 | 11/1973 | Carbonneau | 2/22 |
| 4,627,108 | 12/1986 | Jarvinen | 2/22 |
| 5,507,720 | 4/1996 | Lampropoulos | 2/22 |
| 5,544,663 | 8/1996 | Duback | 128/882 |
| 5,611,080 | 3/1997 | Skottheim | 2/22 |
| 5,717,996 | 2/1998 | Feldmann | 2/22 |
| 5,732,713 | 3/1998 | Duback et al. | 128/882 |
| 5,842,475 | 12/1998 | Duback et al. | 128/882 |

*Primary Examiner*—John J. Calvert
*Assistant Examiner*—Gary L. Welch
*Attorney, Agent, or Firm*—Testa, Hurwitz & Thibeault, LLP

[57] ABSTRACT

The shin guard is generally comprised of a top layer of material and a backing layer of resilient foam material which are joined together by stitching that extends around the perimeter of the shin guard. The shin guard further includes three pads separated by two seams that extend longitudinally along the shin guard. The first pad wraps around the medial side of the shin, i.e., the side facing the opposite leg. A top edge of the first pad lays of the leg beneath the calf muscle so as to not restrict the expansion and contraction of the calf muscle. Inserted between the top layer and the backing layer is a rigid insert that provides added protection from sharp impact injury. The insert has an arcuate shape so as to follow the general contour of the leg when placed in abutting relationship therewith. The center pad also includes an arcuately shaped insert to protect the shin itself. A third pad, also having an arcuately shaped insert, lies on the lateral side of the shin opposite the first pad. This pad is longer than the first pad and thus provides for added protection to the outward-facing portion of the lower leg, which is more exposed to injury than the inward-facing portion.

17 Claims, 3 Drawing Sheets

ATHLETIC SHIN GUARD

CROSS-REFERENCE TO RELATED APPLICATIONS

This application is a continuation of U.S. Ser. No. 08/635,370 filed Apr. 19, 1996.

BACKGROUND OF THE INVENTION

This invention relates generally to protective devices and more particularly to an athletic shin guard designed to protect against impact injuries to the lower leg.

It has been long been the practice of athletes in a variety of sports to protect themselves against injury by wearing soft or rigid pads or guards about particular body parts which might be subject to impact. In soccer, for example, shin guards have been popular to protect against bruising injuries to the lower leg or breakage of the tibia or shin bone.

Early shin guards were simply single pads placed within the socks of athletes at the front of the lower leg adjacent the tibia bone. In most sports, however, injury was just as likely to occur to the sides of the lower legs as to the front. Thus, contoured pads were developed which covered not only the front of the shin but the sides as well.

One such contoured pad is shown in U.S. Pat. No. 4,756,026 to Pierce, Jr. The Pierce, Jr. patent discloses a tubular pad of elastomeric fabric having three stitched pockets which when worn about the lower leg or forearm, would grant protection over 180 degrees, namely the front and sides of the tubular pad. Each of the pockets are filled with a polymeric foam. The front pocket also contained extra protection in the form of a plurality of rigid plastic strips running lengthwise down the outside of the front pocket. Though still bulky, this tri-pad system offers improved flexibility to reduce any restriction of movement of the wearer. Still, the Pierce, Jr. protective pad does not contain rigid supports along the sides to fully protect the lower leg from side impacts.

U.S. Pat. No. 5,384,913 to Hendry discloses a protective guard having a rigid support on the sides as well as the front of the guard running almost the full length of the tibia bone. The side panels of the Hendry guard are symmetrically disposed about the front panel along the entire vertical length of the front panel much like the Pierce, Jr. pad. Each panel has an outer rigid surface to protect the wearer against sharp impacts and a padded inner surface which rests adjacent a wearer's leg to provide cushion and comfort In use, the guard is meant to be removably placed within a pocket defined within an elastic sleeve which is then to be worn about the lower leg. This design offers improved protection over Pierce, Jr. in that both the medial and lateral sides of the lower leg are protected from impact.

Lateral and frontal lower leg protection is particularly important in soccer where the athlete is subjected to tremendous lower leg impact. The frontal protection protects against kicks or slides to the shin bone, which can even cause fractures. The lateral side is also at risk to injury in soccer. Soccer players are frequently kicked or slid into along the lateral side during play as a result of a tackle or play for the ball. The same lower leg impacts can occur in sports such as field hockey, street hockey and American football to name a few. The Hendry guard sufficiently protects the lower leg from such traumas from the front and sides in these sports. The problem with this design is that it reduces mobility since the side panels restricts the expansion and contraction of the calf muscle as the wearer runs or cuts from side to side. This is a particular problem in these sports since quickness and agility are at a premium.

Accordingly, a need remains for an shin guard which offers protection to the front and sides of the lower leg while maximizing mobility of the leg, namely offering reduced restriction of the expansion and contraction of the calf muscle.

SUMMARY OF THE INVENTION

It is, therefore, an object of the invention to improve athlete mobility when using such guards while still maintaining protection against impact injury.

The shin guard according to the invention includes three main components: a center pad adapted to be worn over the front of a lower leg adjacent the shin bone; a medial pad disposed along a lateral side of the center pad; and a lateral pad disposed along a lateral side of the center pad. The medial pad, when worn, has a top edge which runs beneath the lower portion of the calf muscle to enable the calf muscle to flex without being substantially impeded by the shin guard. Although the calf muscle is exposed on the medial side as a result, this side of the leg is less exposed to impact. The medial pad therefore increases athletic performance while not significantly compromising protection of the lower leg. The lateral pad, adapted to be worn against the lateral portion of the lower leg (facing away from the other leg), is substantially larger than the medial pad to provide better protection to this outward facing portion. The three pad shin guard thus has an asymmetric appearance about a longitudinal axis of the center pad.

The shin guard may include a flexible web which connects together the medial and lateral pads to the center pad. This web is formed of a breathable material to allow air to pass through the web in order to enable better air circulation to the skin when the shin guard is worn. Additionally, each of the three pads may include a rigid member having an arcuately curved inner surface to better protect the lower leg from impact injuries and more easily conform to the contour of the leg. A layer of cushioning material, preferably ethyl vinyl acetate (EVA) or other foam, may be attached to the underside of the curved surfaces to add further protection and comfort. Finally, a cloth outer layer may be attached to the outer side of the guard via stitches around the perimeter of the shin guard.

When worn, the shin guard is positioned adjacent the lower leg so that the center pad lays against the shin, and the lateral pad against the lateral or outside portion of the lower leg. The medial side is positioned against the medial or inside portion of the lower leg (that portion closest to the other leg) between the ankle and the generally protruding contour of the calf muscle. The smaller pad size relative to the lateral pad strikes a balance between protection and freedom of movement.

An advantage of the invention is improved comfort by eliminating unnecessary restrictions.

Another advantage of the invention is enhanced athletic performance by eliminating unnecessary restrictions.

The foregoing and other objects, features and advantages of the invention will become more readily apparent from the following detailed description of a preferred embodiment of the invention which proceeds with reference to the accompanying drawings.

DETAILED DESCRIPTION

Figure 1:
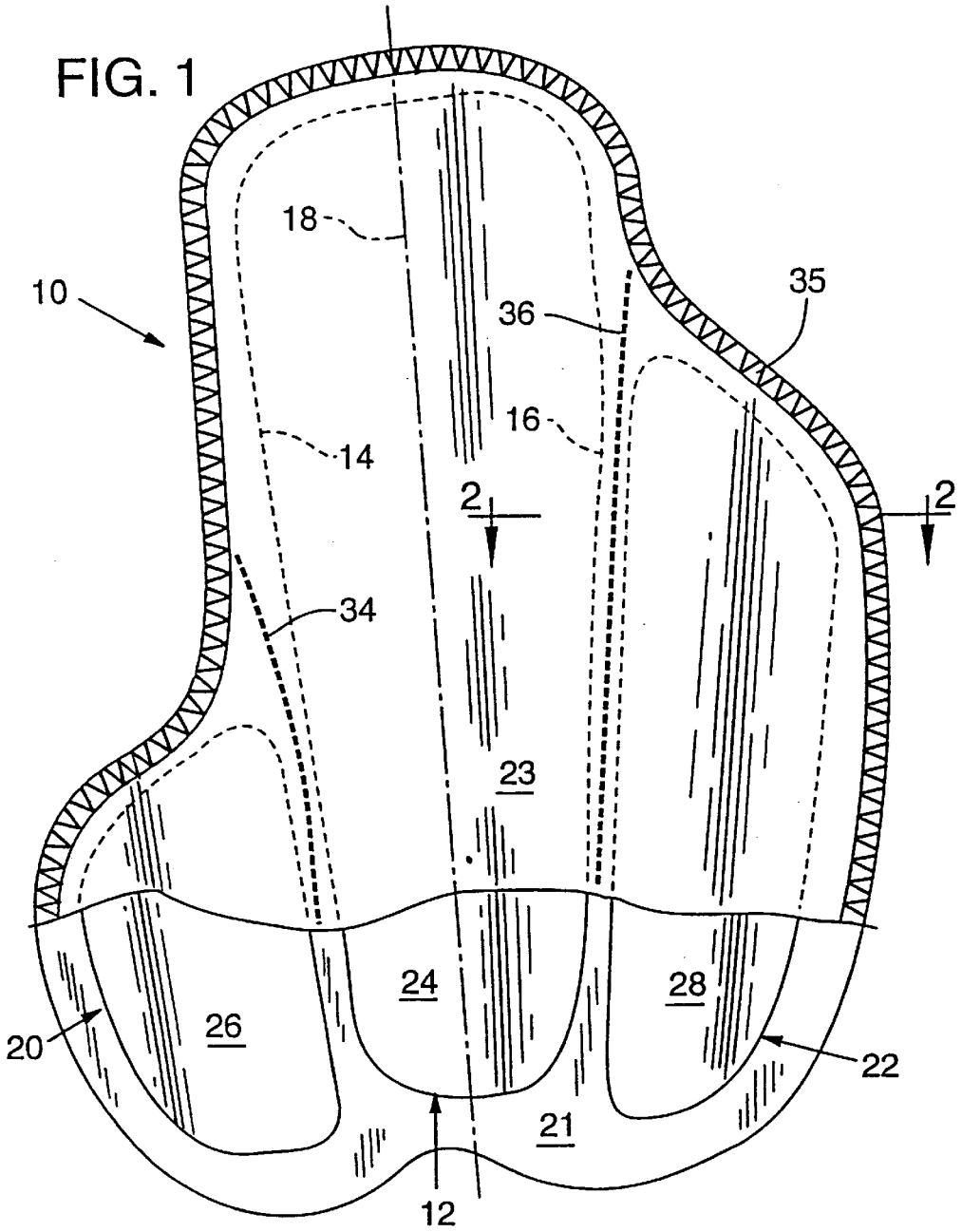
FIG. 1 is a partially sectioned front elevational view of a first embodiment of the shin guard invention.

Referring to FIG. 1, a shin guard for a left leg is shown generally at 10. A shin guard for a right leg according to the invention is the mirror image of that shown in FIG. 1. Guard 10 includes a center pad 12 having a medial edge 14 and a lateral edge 16 disposed on medial and lateral sides, respectively, of a longitudinal axis 18 of the center pad. Guard 10 further includes a medial pad 20 which is spaced from the medial edge 14 of center pad 12. A lateral pad 22 is in spaced apart relation to the lateral edge 16 of center pad 12. The guard is contoured so as to fit around a lower leg with the center pad disposed along the tibia or shin bone, the medial pad disposed along a medial side of the leg, and the lateral pad disposed along the lateral side of the leg. The guard according to the invention is not limited to having all three pads. In a simpler embodiment of the invention, the larger lateral pad may be omitted so that the guard includes only a center pad and a smaller side pad such as pad 20. The guard can then be worn on either leg so that the smaller side pad is positioned on either the lateral or medial sides of the leg. The exact relationship between the pads and the leg is discussed further below with respect to FIGS. 5–6.

Each pad, in the preferred embodiment, is comprised of three layers as shown in the partially sectioned view of FIG. 1. The three layers include a foam cushioning backing layer 21, a rigid layer, and a breathable mesh layer 23. The backing layer 21 cushions the leg from the force of an impact as well as separates the rigid layer from the leg so that it does not irritate the skin. The backing layer may be worn against the skin or, alternatively, may be worn over a sock. The backing layer may be made of any number of commercially available materials such as 100% ethyl vinyl acetate (EVA) approximately ⅛ inch think, SBR foam, as well as other cushioning material. The mesh layer may also take a variety of forms depending on the desired durability and breathability. These two parameters being inversely related. The mesh layer may be formed from a natural fiber such as cotton or a synthetic material such as Polyester yarn or Nylon, for example, or any combination thereof. The rigid layer may be formed on any material with sufficient hardness to resist the typical forces encountered in these sports. Examples include a six layer fiberglass having a Pyramid construction, plastic, carbon fiber or even metal. The rigid layer should be light weight, however, so as to not burden the athlete.

In the preferred embodiment, the rigid layer includes three separate elements 24, 26 and 28 (FIG. 1), which are interposed between the cushioning layer 21 and the mesh layer 23. Alternatively, a single sheet of or similar rigid material may be used. Rigid members 24, 26 and 28 are shown partially by dashed lines to show their placement within the interior of guard 10. The rigid members may also include raised longitudinal ridges (not shown) to improve the structural strength thereof. Element 24 forms a part of the center pad 12, while elements 26 and 28 form a part of the medial and lateral pads, respectively. The elements are held in place between the opposing layers by a seam 35 that runs around the outer perimeter of the guard and by two individual seams 34 and 36 between the pads. Alternatively, the rigid members may be secured between the layers by an adhesive. In addition, pockets or receptacles could be formed on the respective pads so that the rigid members could be inserted and removed depending on the potential for hard impact injury, e.g., practice versus competition. These receptacles could alternatively allow the rigid members to be attached to the pads by hook and eye material (e.g., Velcro) 97 (FIG. 4) wherein the rigid members contain hook material on a back side thereof and the receptacles on the pads contain eye material (or vice versa) so that the rigid members may simply be pressed against the pads so that the hook and eye material interengage to hold the rigid members in place. Other receptacles such as straps, loops, slots, etc., may be used to receive the rigid members on their respective pads.

Figure 3:
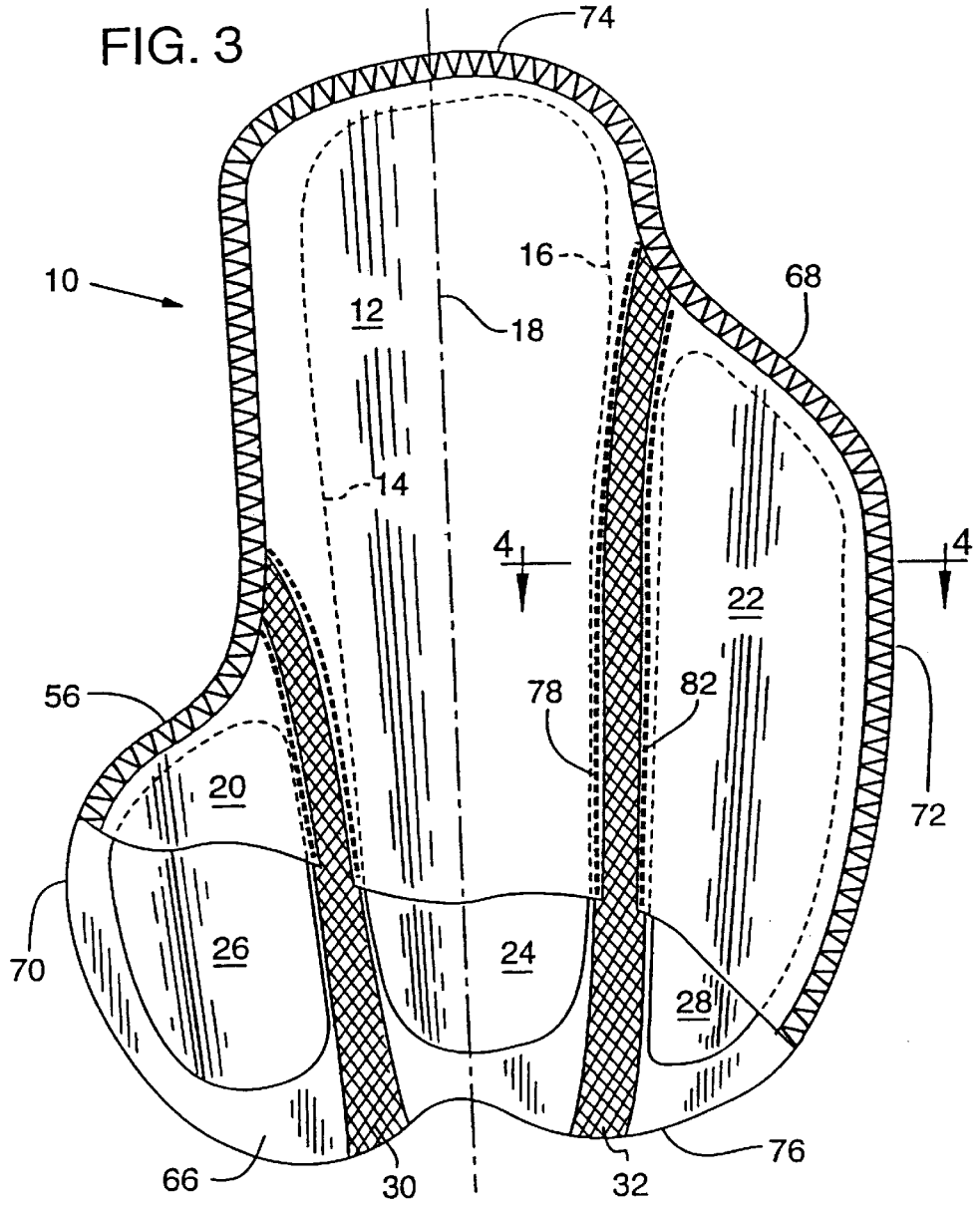
FIG. 3 is a partially sectioned front elevational view of a second embodiment of the shin guard invention.
Figure 4:
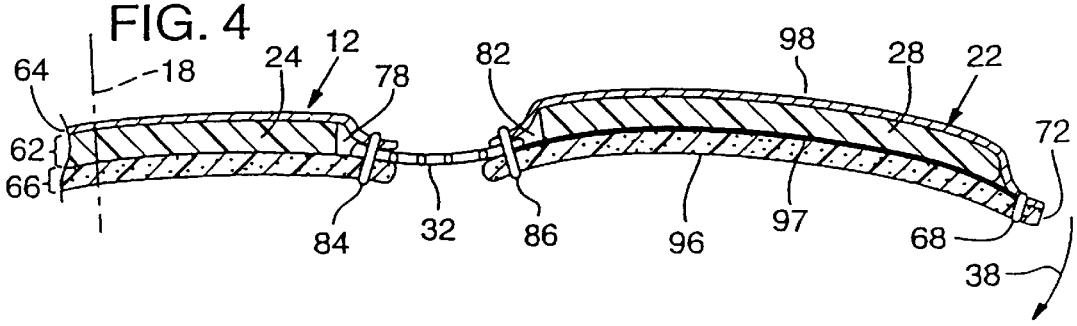
FIG. 4 is a cross sectional view taken along lines 4—4 of the shin guard of FIG. 3.

In an alternative embodiment of the invention, the spaced medial and lateral pads 20, 22 are connected to the center pad 12 by a flexible joint, such as webs 30, 32 in FIG. 3, disposed between the pads. The webs hingedly connect pads 20 and 22 to the center pad to enable the guard 10 to fit lower legs of a variety of sizes. Hinged movement of pad 22 is shown in FIG. 4 by arrow 38. In its preferred embodiment, web 30, 32 is of a loose weave or elastic material to provide a breathable space between the pads so that air may flow through the flexible web 30, 32 for increased comfort over long periods of wear. Preferable materials for the flexible web include those described above for the mesh layer as well as more elastic materials such as Polyester (19%), Polyprophylane (49%), and rubber (32%) composition.

Referring now to FIG. 4, a cross sectional view of guard 10 in FIG. 3 is shown. The guard includes a middle layer 62 formed of rigid material sandwiched between an outer mesh layer 64 and an inner cushioning backing layer 66. Though middle layer is shown as incorporating individual members 24 and 28, it is understood that guard 10 may be produced from a single rigid piece which spans from the medial to the lateral side of the lower leg. The flexible web 32 spanning between the center and lateral pads 12 and 22 is stitched between inner and outer layers 64, 66, as by seams 84, 86.

Figure 2:
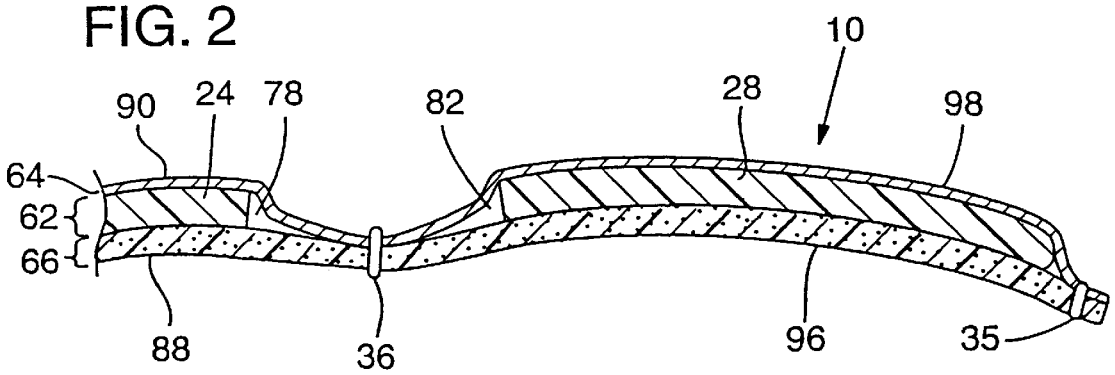
FIG. 2 is a cross sectional view taken along lines 2—2 of the shin guard of FIG. 1.

In the preferred embodiment, outer layer 64 is attached, as by seam 68, to inner layer 66 along outer edges to form medial and lateral edges 70, 72 and top and bottom edges 74, 76 of the guard. As shown by FIGS. 1–2, the outer layer 64 may be attached to the inner layer along two approximately parallel inner seams 34,36 to thereby form a center pocket 78, a medial side pocket 80 (not visible), and a lateral pocket side pocket 82. Rigid center, medial and lateral members 24, 26 and 28 (forming the rigid middle layer 62) may then be received within respective pockets 78, 80 and 82. In that case the top edge 74 may be left open so that the rigid members may be slidably removed from the pockets.

Rigid members 24, 26 and 28 are preferably arcuately shaped to provide a curve to the guard which enables it to fit better about the lower leg. Inner surfaces of center, medial and lateral pads (e.g., 88 and 96) are designed to fit against the contour of the lower leg while outer surfaces (e.g., 90 and 98) face outward from the lower leg.

Figure 5:
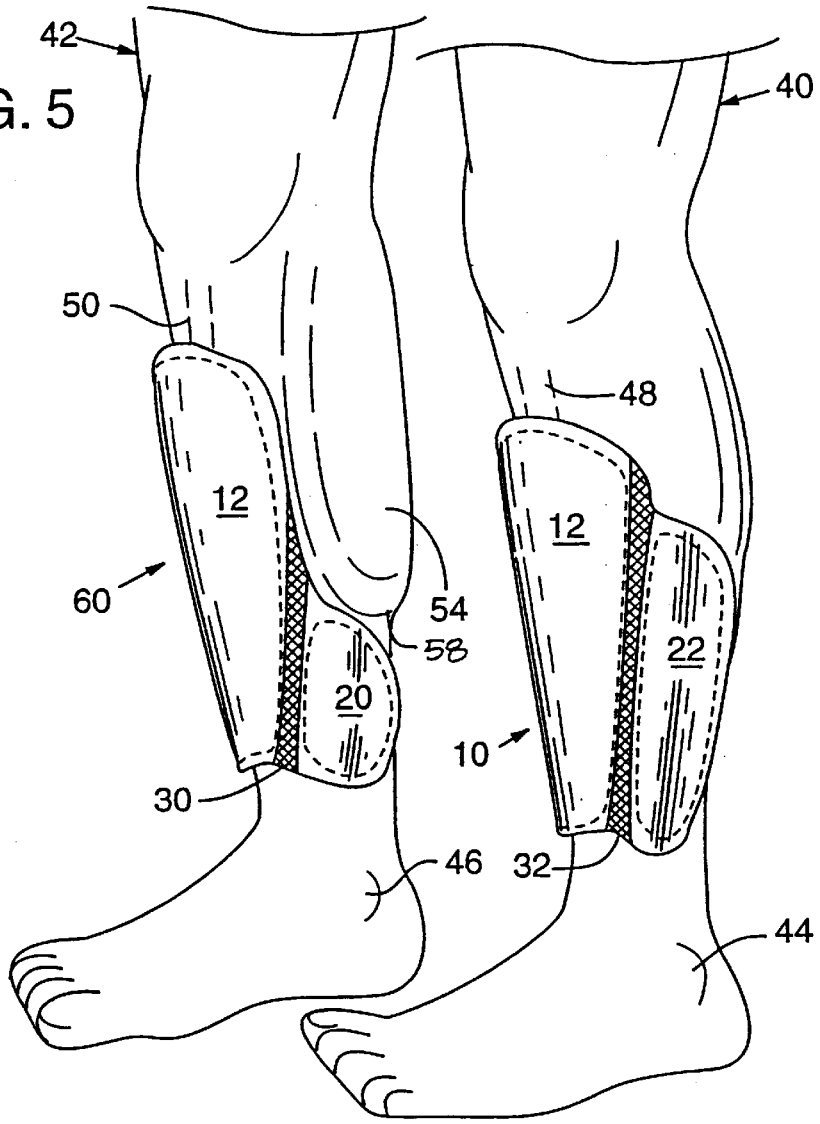
FIG. 5 is a perspective view showing left and right legs with left and right versions of the shin guard invention thereon.
Figure 6:
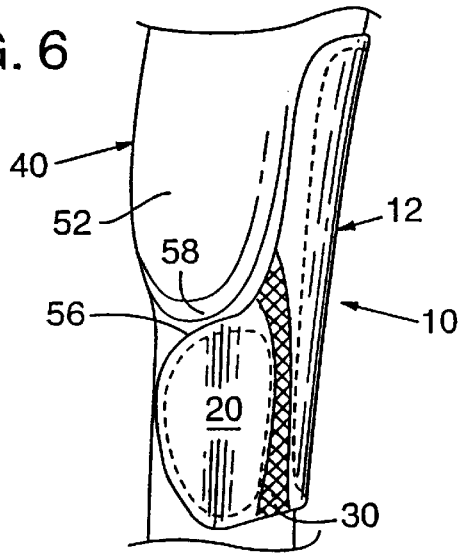
FIG. 6 is a side elevation view of the shin guard of FIG. 3 as worn on a lower left leg.

In use, guard 10, as shown in FIGS. 5 and 6, is designed to fit adjacent the lower left leg to protect the shin bone and soft tissue against impact injuries. It is understood that a guard designed to fit adjacent the lower right leg of a wearer, such as guard 60 shown in FIG. 5, would be the mirror image of guard 10 for the reasons discussed more fully below.

FIGS. 5 and 6 show guard 10 (of FIG. 3) worn on a lower left leg 40. A shin guard adapted to worn on a right leg 42 is shown generally at 60. The lateral malleolus of the left leg, or ankle bone of the outer portion of the leg, is shown at 44. The medial malleolus of the right leg, or ankle bone on the interior of the leg, is shown at 46. The location of the shin bones on respective left and right legs are shown by dashed lines as 48, 50.

FIGS. 5 and 6 show at 52 and 54 the generally protruding contour of the calf muscle on the medial sides of the left and right legs. The calf muscle being understood to include but is not limited to the Gastrocnemuis muscle. The calf muscle protrudes outwardly away from the shin bone on both the medial and lateral sides of the shin bone, as viewed from a front or rear elevational view of the lower leg. Referring particularly to FIG. 6, guard 10 is placed against the lower portion (below the knee) of the left leg 40 so that the top edge 56 of medial pad 20 lays beneath a lower, arcuate shaped portion 58 of calf muscle 52. When the muscle is in its elongate state, i.e., with the toes above the heel, the top edge 56 is just below the arcuate shaped portion of the calf and generally follows the outline thereof. When the muscle is flexed, the arcuate shaped portion of the calf moves up the leg and away from the top edge 56. Thus, the top edge 56 lies just below the arcuate shaped portion 58 regardless of the state of the calf muscle. Since the medial pad 20 lays beneath that portion of the calf muscle which changes shape as the calf alternately flexes and relaxes, as when running, the pad minimizes any impediment to the wearer's movements, thereby enhancing athletic performance. Alternatively, the top edge could overlie a portion of the calf muscle as it moves from its elongate position to its flexed position depending on the desired amount of protection. In that case, however, the medial pad will present some impediment to the expansion and contraction of the calf muscle. A lateral pad may also be designed according to the inventive principle of the invention so that the top edge of the lateral pad underlies the bottom side of the calf muscle on the lateral side.

Having described and illustrated the principles of the invention in a preferred embodiment thereof, it should be apparent that the invention may be modified in arrangement and detail without departing from such principles. For example, both side pads need not be included on the shin guard. Only one pad may be used in conjunction with the center pad to form the guard. In addition, the larger lateral pad may be replaced by a smaller lateral pad having the same basic shape as the smaller medial pad. Moreover, one or more of the layers (e.g., the rigid layer) that makeup the shin guard may be perforated so as to reduce the weight of the guard while still maintaining adequate protection. The flexible mesh layer may also be continued around the back of the leg to form a leg receiving sleeve to allow the guard to be held on the leg by the elastic force of the mesh layer. I claim all modifications and variation coming within the spirit and scope of the following claims.

I claim:

1. A protective shin guard comprising:

a central portion having a medial side, a lateral side and a longitudinal axis running centrally through the central portion;

a medial portion disposed along a medial side of the central portion and adapted to fit between a lower portion of a calf muscle and an ankle of the lower leg, and a lateral portion disposed along a lateral side of the central portion and longer than the medial portion, the shin guard being asymmetric about the longitudinal axis of the central portion.

2. The protective shin guard according to claim 1 wherein said medial portion includes an upper edge that follows a contour of the lower portion of the calf muscle.

3. The protective shin guard of claim 1 further including:

an outer layer of mesh material; and an inner layer of cushioning material.

4. The protective shin guard of claim 3 further including:

a perimeter seam running around a perimeter of the shin guard;

a first seam running between the central portion and the medial portion; and a second seam running between the central portion and the lateral portion whereby a center pocket is formed within the center portion, a medial pocket is formed within the medial portion, and a lateral pocket is formed within the lateral portion.

5. The protective shin guard of claim 4, which further comprises a rigid center member received within the center pocket, a rigid medial member received within the medial pocket, and a rigid lateral member received within the lateral pocket.

6. A method for protecting the lower leg of a person, said lower leg including a shin bone running centrally down the lower leg adjacent a front surface and a calf muscle running along a medial portion of the lower leg having a lower portion thereof of a general protruding contour, said method comprising:

providing a central pad having a medial side, a lateral side and a longitudinal axis running centrally through the central pad;

providing a medial pad disposed along a medial side of the central pad and adapted to fit between a lower portion of a calf muscle and an ankle of the lower leg; and, providing a lateral pad disposed along a lateral side of the central pad and longer than the medial pad, the shin guard being asymmetric about the longitudinal axis of the central pad.

7. The method of claim 6, further including:

providing a center pad having medial and lateral sides disposed about a longitudinal axis and outer and inner surfaces; and placing the inner surface center pad adjacent the front portion of the lower leg of a person so that it substantially covers and protects the shin bone.

8. The method of claim 7, wherein the method further includes:

providing a lateral pad having outer and inner surfaces; and positioning the lateral pad adjacent the lateral side of the center pad, said lateral pad covering substantially more of the lower leg than the medial pad.

9. The method of claim 8, wherein the method further includes attaching the center pad and medial pad together along a first flexible joint to enable the medial pad to hinge about the flexible joint.

10. The method of claim 8, wherein the method further includes:

attaching the center pad and medial pad together along a first flexible joint; and attaching the center pad and lateral pad together along a second flexible joint to enable the medial and lateral pads to independently hinge about their respective flexible joints.

11. A shin guard for protecting a lower leg from impact injuries, the lower leg having a shin bone running centrally down the length of the lower leg and terminating at an ankle, the shin bone flanked by a lateral side and by a medial side, the lower leg further including a calf muscle having a lower portion thereof protruding outwardly away from the shin bone, the shin guard comprising:

a center receptacle positionable along the shin bone, said center receptacle having a first edge and a second edge disposed on opposite sides of a longitudinal axis running through the center receptacle; and a first side receptacle disposed along the first edge of the center receptacle, said first side receptacle having a top edge running beneath the lower portion of the calf muscle to minimize interference with the calf muscle when the guard is positioned on the lower leg.

12. A shin guard according to claim 11, wherein the first side receptacle includes:

a bottom layer having a top side and a bottom side; and a top layer attached to the top side of the bottom layer so as to form a receptacle between the bottom layer and the top layer.

13. A shin guard according to claim 12, wherein the side receptacle includes a rigid protective piece inserted into the receptacle formed between the two layers.

14. A shin guard according to claim 12, wherein the side receptacle includes a seam running along an outer peripheral edge to attach the top and bottom layers together.

15. A shin guard according to claim 11, further including a web interposed between the center receptacle and the first side receptacle.

16. A shin guard according to claim 11, further including a second receptacle disposed along the second edge of the center pad, said second side receptacle having a top edge running beneath the lower portion of the calf muscle to minimize interference with the calf muscle by the second side pad when the guard is positioned on the lower leg.

17. A shin guard according to claim 11 further comprising a rigid protective piece having an interengaging material disposed along a backside thereof, wherein the center receptacle includes a mating interengaging material disposed along a front side thereof for engaging the interengaging material of the protective piece to hold the protective piece in place.

* * * * *